United States Patent [19]

Uchida et al.

[11] Patent Number: 4,600,908

[45] Date of Patent: Jul. 15, 1986

[54] CIRCUIT BREAKER

[75] Inventors: Naoshi Uchida; Kiyoshi Kandatsu, both of Saitama, Japan

[73] Assignee: Fuji Electric Company Ltd., Kawasaki, Japan

[21] Appl. No.: 687,868

[22] Filed: Dec. 31, 1984

[30] Foreign Application Priority Data

Jan. 30, 1984 [JP] Japan ..... 59-11533[U]

[51] Int. Cl.[4] ..... H01H 75/00; H01H 77/00; H01H 83/00

[52] U.S. Cl. ..... 335/8; 335/10; 335/16

[58] Field of Search ..... 335/8, 10, 6, 16

[56] References Cited

U.S. PATENT DOCUMENTS 4,278,958 7/1981 Kandatsu ..... 335/16

*Primary Examiner*—Harold Broome

*Attorney, Agent, or Firm*—Finnegan, Henderson, Farabow, Garrett & Dunner

[57] ABSTRACT

A circuit breaker for high-speed current-limiting breaking of a three-phase current in the event of a short-circuit condition. The breaker has three pairs of fixed and movable contactors, the latter being arranged for pivoting movement on a common shaft. The center movable contactor is biased against an opposing holder, such that in the event of a short-circuit, the bias is overcome and the movable contactors separate in unison from the fixed contactors.

3 Claims, 6 Drawing Figures

CIRCUIT BREAKER

BACKGROUND OF THE INVENTION

The present invention relates to a multipolar circuit breaker in which a fixed contactor, a movable contactor, a switch mechanism, a tripping device, an arc extinction device, etc., are contained within a single molded casing and in which high speed current-limiting circuit-breaking is performed upon occurrence of a short-circuit current.

Low voltage circuit breakers have been recently remarkably developed and popularized as an overcurrent protecting device in, for example, a no-fuse circuit breaker for use in a low voltage line, and they have been required not only to increase in capacity of the rated current and the breaking current, but also to make higher the performance as well as function thereof, so that remarkable technical progress has been achieved to provide a current-limiting type low-voltage circuit breaker of high efficient breaking capability as a part of such progress.

Generally, it is known that in the case where a three-phase short-circuit current is broken by such a circuit breaker of this kind, if the first phase current can be broken in a very short time, the breaking of the succeeding second and third phase currents is facilitated. Accordingly, how to rapidly complete the breaking of the first phase current is the main point in improvement in performance of breaking a three-phase short-circuit current. In the case of a current limiting mechanism used in the conventional current-limiting type circuit breaker, a movable contactor and a fixed contactor are disposed such that currents flow in the respective movable and fixed contactors in the opposite directions to each other, so that, upon occurrence of a short-circuit current, the lock of a current-limiting device provided in each of the respective three-phase poles is released by utilizing an electromagnetic repulsion force generated between so-called two parallel conductors so as to cause the movable contactor to rapidly separate from the fixed contactor. In this system, however, as shown in FIG. 1, since a natural current zero point a appears in the first phase current in the earliest among the currents of the three phase, the above-mentioned electromatnetic repulsion force is too small to release the lock state so that current-limiting mechanism is not actuated. The current-limiting mechanism of the succeeding major current phase which generates a sufficiently large electromagnetic repulsion force is actuated to operate to cause the contactors of this phase to separate from each other so that the circuit breaking is thus performed.

Thus, in the conventional circuit breaker, it takes a time from the occurrence of a short-circuit current to the breaking thereof because the first phase current cannot be broken in a very short time, so that the arc energy to be broken becomes large and it becomes necessary to strengthen the circuit breaker thermally as well as mechanically. Further, since current-limiting mechanisms are individually provided in the pole breaking portions for the respective phases, the number of the parts constituting the circuit breaker increases to make the circuit breaker larger in size in comparison with a non-current-limiting type circuit breaker that is provided with no such current-limiting mechanism. In addition to this, the circuit breaker necessarily has a further disadvantage that the arrangement becomes complicate to increase the steps of assembling to thereby increase in cost.

SUMMARY OF THE INVENTION

In view of the above-mentioned disadvantage, an object of the present invention is to provide a circuit breaker of the multipole-simultaneously-breaking type provided with a current-limiting mechanism, in which separating operations of contactors of respective poles are simultaneously performed for the circuit breaking operation at the natural current zero point of the first current phase as soon as a short-circuit current occurs so as to minimize the energy of an arc generated at the circuit breaking operation, and which is simple in arrangement, small in the number of parts, and easy in assembling.

The above-mentioned object of the present invention is attained by the circuit breaker in which among contactors of three poles arranged such that the opening/closing operation of the three poles are simultaneously performed by a common switch shaft, a center one of the contactors comprises a movable contactor, a holder for holding the movable contactor, a shaft inserted into modified elliptical holes respectively formed in opposite side walls of the holders, a link engaged with the shaft to be connected with a switch mechanism, another shaft for supporting the movable contactor on the holder, a spring for urging the first-mentioned shaft inserted into the modified elliptical holes in the direction to make the shaft engage with slot portions of the respective modified elliptical holes, and a rotary shaft of the holder arranged in the opposite side to the supporting shaft of the movable contactor with respect to the link, whereby the link is rotated in the counterclockwise direction about the first-mentioned shaft connecting link with the switch mechanism by an electromagnetic repulsion force generated by a short-circuit current between the movable contactor and a fixed contactor disposed in opposition to the movable contactor, so that the first-mentioned shaft engaging with the slot portions of the respective modified elliptical holes are caused to disengage from the slot portions to move along the walls of the respective modified elliptical holes and at the same time the holder is caused to rapidly rotate in the clockwise direction about the rotary shaft, thereby causing the contactors of all the poles to simultaneously perform their opening operation through the common switch shaft.

DETAIL DESCRIPTION OF THE PREFERRED EMBODIMENTS

A preferred embodiment of the present invention will now be described with reference to the accompanying drawings.

Figure 1:
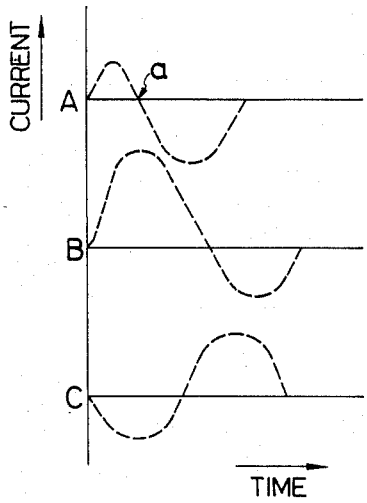
FIG. 1 is a diagram showing changes in current of the respective phases in three-phase short-circuit breaking.
Figure 2:
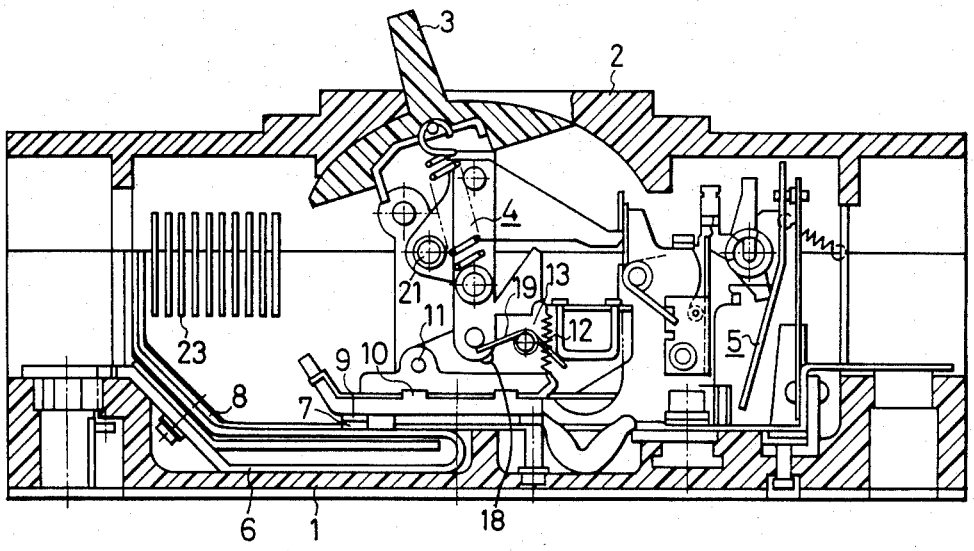
FIG. 2 is a schematic longitudinal cross-section of the circuit breaker according to the present invention.

In a three-pole circuit breaker as shown in FIG. 2, reference numeral 1 designates a molded casing, 2 a molded cover, 3 a switch handle, 4 a switch mechanism, and 5 a tripping device. Among the contactors of the three poles, a fixed contactor 6 of the center pole is bent into a U-shape. A fixed contact 7 and an arc horn 8 are connected to the fixed contactor 6. A movable contactor 10 having a movable contact 9 is disposed in parallel with the fixed contactor 6. The movable contactor 10 is supported on a holder 13 by a supporting shaft 11 and is urged against the fixed contactor 6 with a predetermined contact pressure by a tensile force of a spring 12 held by the holder 13. Accordingly, the movable contactor 10 may be brought into a closed state or an opened state with respect to the fixed contactor 6 by means of the switch mechanism 4, the shaft 11, the holder 13, and the spring 12.

Figure 3:
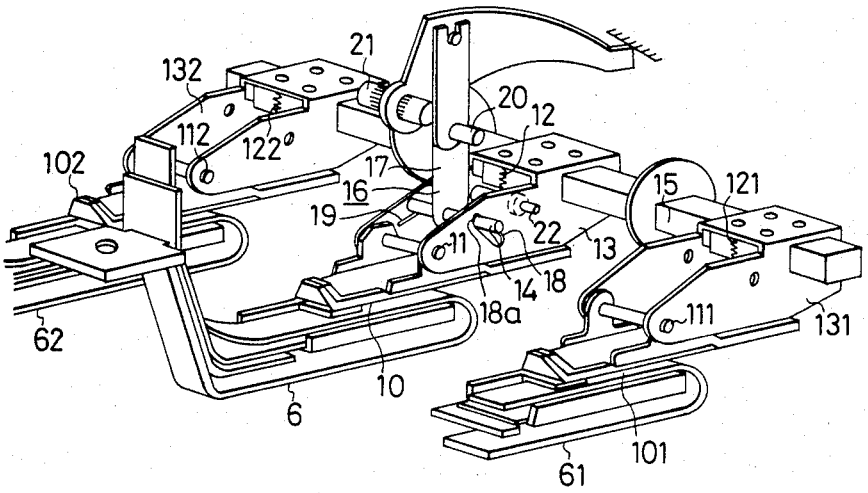
FIGS. 3 and 4 are schematic perspective views showing the current-limiting mechanism in the closed state and in the state of circuit opening operation respectively.
Figure 4:
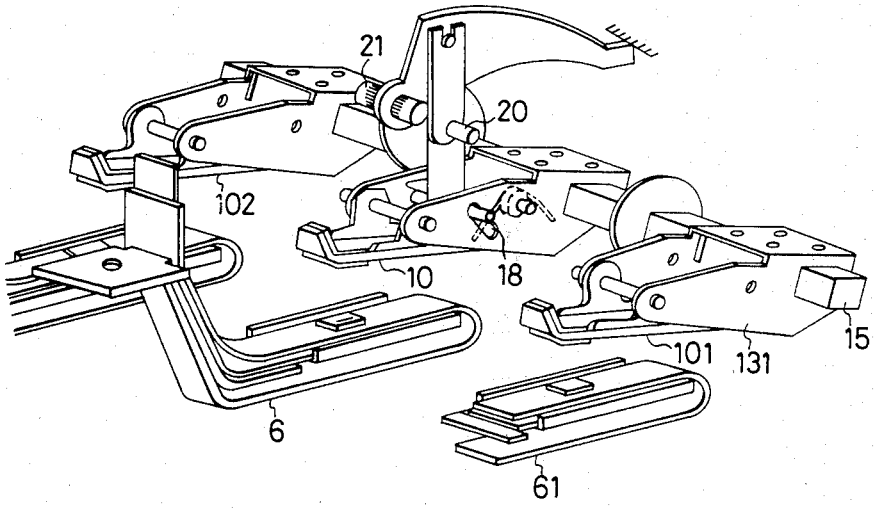

The holders 13, 131, and 132 of the respective poles are fixed on a common shaft 15 of an insulator material (FIGS. 3 and 4) such that they are rotatable in the clockwise direction about a rotary shaft 22 provided on the holder 13 of the center pole. Accordingly, the opening/closing of the respective paths between the movable contactors 10, 101, and 102 and the corresponding fixed contactors 6, 61, and 62 are performed at the same time. A current-limiter 16 is provided only at the center pole and constitutes a shaft 14 engaging with slot portions 18*a* of respective modified elliptical holes 18 formed in opposite side walls of the holder 13, a link 17 coupled to the shaft 14 and connected to the switch mechanism 4 through a shaft 20, and a torsion spring 19 having a center positioned coaxially over rotary shaft 22 of the holder and having an end biasingly engaging shaft 14.

Figure 5:
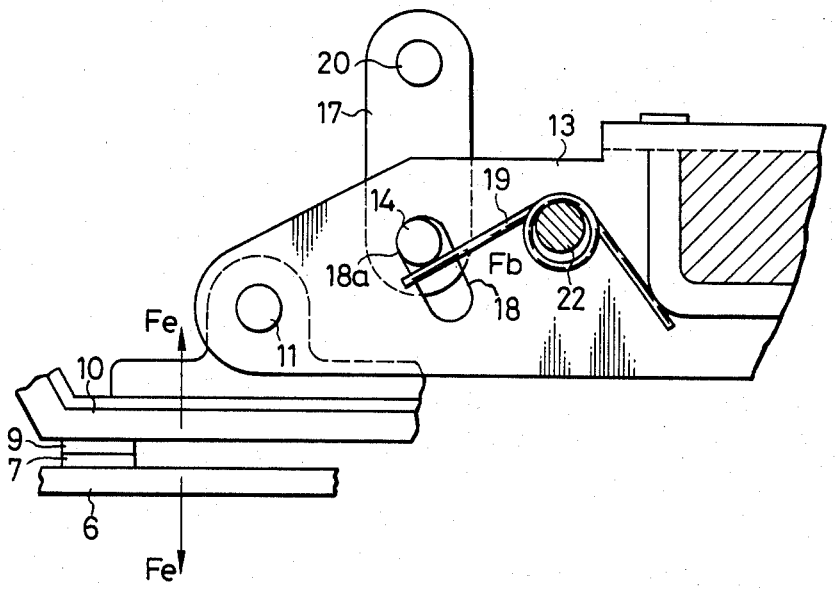
FIG. 5 is a schematic diagram showing the arrangement of the current-limiting mechanism.

In thus arranged current-limiter mechanism 16 (FIG. 5), an electromagnetic repulsion force Fe acts between the parallel conductors, that is, the fixed contactor 6 and the movable contactor 10 in the direction of the arrows in FIG. 5 when a short-circuit current occurs. The electromagnetic repulsion force Fe is transmitted to the shaft 14 through the supporting shaft 11 and the holder 13 per se so that a component Fb of the force Fe overcomes the repulsion force of the torsion spring 19 and the link 17 rotates in the counterclockwise direction about the shaft 20.

Accordingly, although the shaft 14 also moves together with the link 17, the shaft 14 is disengaged from the slot portions 18*a* when it has moved by a predetermined distance and moves down along the walls of the respective modified elliptical holes 18. At the same time, the holder 13 is released from the restriction in its closed state and rapidly rotated in the clockwise direction about the rotary shaft 22 by the electromagnetic repulsion force Fe so that the respective contactors of the three poles are simultaneously opened through the switch shaft 15. The holder 13 rotates by a distance sufficient for driving an arc generated at a gap between the respective contacts 7 and 9 of the fixed and movable contactors to an arc extinction chamber 23. Thereafter, the arc is extinguished in a short time by the multiplicated effect and also by the separation of contactors by the usual tripping operation. At that time, the holder 13 strikes against a stopper 21 to be restricted before the operation of the switch mechanism 4 has completed, and then the shaft 14 moves up along the walls of the modified elliptical holes 18 to engage with the slot portions 18a to complete the separation between the contacts.

As described above, the current-limiting type multipolar circuit breaker according to the present invention has an effect that, since the contactors of the respective poles are simultaneously opened at the natural current zero point of the first current phase as soon as a short-circuit current occurs, the arc energy when breaking is performed can be suppressed to a small value. The circuit breaker can be simply constituted by parts which are small in number and easily assembled so that the circuit is made compact and inexpensive.

Figure 6:
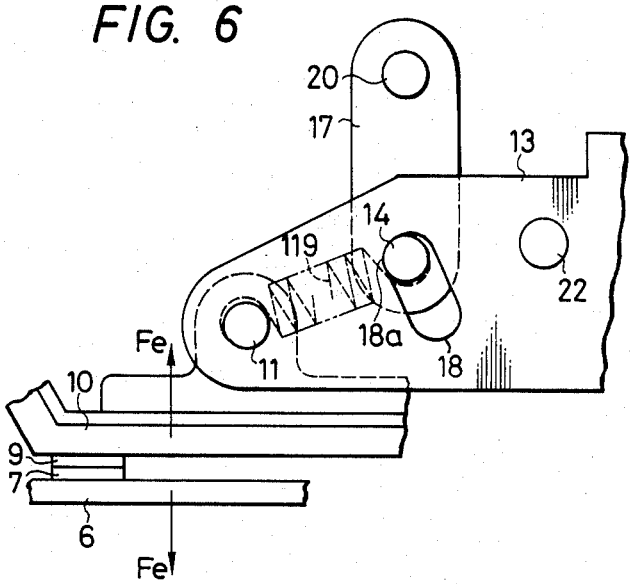
FIG. 6 shows another embodiment of the invention.

FIG. 6 shows another embodiment of the present invention which is substantially the same as the preceding embodiment except for the biasing means for the shaft 14. In FIG. 6, instead of the torsion spring 19, a coil spring 119 is used. The coil spring 119 is interposed between the supporting shaft 11 and the shaft 14. The function of the spring 119 is the same as that of the spring 19 in the preceding embodiment so that substantially the same effect may be obtained. The structure and operation of the embodiment shown in FIG. 6 is apparent from the foregoing description and a detailed explanation thereof has been omitted.

What is claimed is:

1. A circuit breaker including fixed contactors each having a pole, movable contactors, each having a pole adapted to couple with the corresponding pole of a respective one of the fixed contactors, a switch mechanism, a tripping device, an arc extinction device and a molded casing, wherein high-speed current-limiting breaking is performed upon occurrence of a short-circuit current, said circuit breaker comprising:

a common switch shaft coupled to said movable contactors such that opening/closing operations of said poles are simultaneously performed, a center one of said movable contactors comprising a master movable contactor;

a holder for holding said master movable contactor;

a first shaft inserted into a modified eliptical hole formed in a side wall of said holder;

a link engaged with said first shaft and coupled to the switch mechanism, said first shaft connecting said link to said switch mechanism;

a second shaft for supporting said master movable contactor on said holder;

spring means for urging said first shaft to engage with an end portion of said respective modified elliptical hole; and a rotary shaft coupled to said holder and arranged on a side opposite to said second shaft with respect to said link, said link rotating in a first direction about said first shaft by an electromagnetic repulsion force generated by a short-circuit current between said master movable contactor and the fixed contactor disposed in opposition to said master movable contactor, said first shaft simultaneously disengaging from said end portion of said ellipitcal hole to move along a side of said elliptical hole and, at the same time, said holder rapidly rotating in a second direction about said rotary shaft opposite said first direction, thereby causing all the poles of said contactors to simultaneously perform their opening operations through said common switch shaft.

2. The circuit breaker of claim 1, wherein said spring means comprises a torsion spring disposed around said rotary shaft.

3. The circuit breaker of claim 1, wherein said spring means comprises a coil spring interposed between said first shaft and said second shaft (11).

* * * * *